US005971789A

United States Patent [19]

Sukegawa

[11] Patent Number: 5,971,789

[45] Date of Patent: Oct. 26, 1999

[54] LOCKING ANGULAR ELECTRICAL CONNECTING PLUG WITH ROTATABLE RELEASE HANDLE

[75] Inventor: Akihito Sukegawa, Hitachinaka, Japan

[73] Assignee: Mitsumi Electric Co., Ltd., Japan

[21] Appl. No.: 09/032,606

[22] Filed: Feb. 27, 1998

[30] Foreign Application Priority Data

Feb. 28, 1997 [JP] Japan ..... 9-061850

[51] Int. Cl.[6] ..... H01R 13/627

[52] U.S. Cl. ..... 439/352; 439/484

[58] Field of Search ..... 439/352, 484, 439/353

[56] References Cited

U.S. PATENT DOCUMENTS

| | | | |
|---|---|---|---|
| 4,872,736 | 10/1989 | Meyers et al. | 439/352 |
| 4,986,766 | 1/1991 | Leonard et al. | 439/352 |
| 5,026,298 | 6/1991 | Brussalis et al. | 439/352 |
| 5,057,036 | 10/1991 | Dickie | 439/484 |
| 5,332,330 | 7/1994 | Kameko | 439/352 |

*Primary Examiner*—Neil Abrams
*Assistant Examiner*—J. F. Duverne
*Attorney, Agent, or Firm*—Morrison Law firm

[57] ABSTRACT

A box-shaped main plug unit is connected at one end to a cable. A plug of the main plug unit is insertable into plug insertion openings of a connector socket. A lock claw of a lock member is affixed to the main plug unit, and is positioned to lock into latch openings of the plug insertion openings. A slider is slidably supported on the main plug unit. When the slider is slid on the main plug unit it forcibly disengages the lock claw from the latch opening. A pull-out handle is rotatably supported on the slider. The pull-out handle is rotatable between a protected inoperative position and a projecting operative position where it permits application of removal force on the main plug unit. A fixed projection is integrally formed on the slider to further aid in the application of a pull-out force to the main plug unit.

11 Claims, 4 Drawing Sheets

LOCKING ANGULAR ELECTRICAL CONNECTING PLUG WITH ROTATABLE RELEASE HANDLE

BACKGROUND OF THE INVENTION

The present invention relates to a connector plug for connecting electronic components. In particular, the present invention relates to an angular connector plug that can be used in connector sockets where a plurality of plug insertion openings are arranged side-by-side.

In general, when a connector plug connected to a connector sockets is unexpectedly pulled out from the connector socket, significant problems such as the loss of transmitted data can occur.

To handle this problem, Japanese Utility Model Laid-Open Publication Number 4-16885 discloses an invention wherein a lock member is disposed on a connector plug. This lock member engages a latch opening of the connector socket, thus preventing the connector plug from being unexpectedly pulled out from the connector socket. With this connector plug, removing the connector plug from the connector socket involves manually operating an unlock ring in order to force the lock member to the unlocked position.

In some connector sockets for audio-visual devices, a connector socket on which is formed a plurality of plug insertion openings is used (for example, to connect a plurality of media devices such as VCRs). This type of connector socket structure, however, has a very large number of connector pins, and the plug insertion openings are spaced very close to each other. Thus, there is insufficient space available for manually operating the unlock ring. Since these connectors cannot be designed as round connector plugs, unlock rings as described above cannot be used.

OBJECTS AND SUMMARY OF THE INVENTION

It is an object of the present invention to overcome the problems of conventional connector plugs as described above and to provide an angular connector plug that can be used for connector sockets that provide limited space for manual operations and that have a plurality of plug insertion openings with many connector pins.

Briefly stated, the present invention provides a box-shaped main plug unit connected at one end to a cable. A plug of the main plug unit is insertable into plug insertion openings of a connector socket. A lock claw of a lock member is affixed to the main plug unit, and is positioned to lock into a latch opening of the plug insertion openings. A slider is slidably supported on the main plug unit. When the slider is slid on the main plug unit it forcibly disengages the lock claw from the latch opening. A pull-out handle is rotatably supported on the slider. The pull-out handle is rotatable between a protected inoperative position and a projecting operative position where it permits application of removal force on the main plug unit. A fixed projection is integrally formed on the slider to further aid in the application of a pull-out force to the main plug unit.

According to an embodiment of the invention, there is provided an angular connector plug for connection with a connector socket comprising: a main plug unit having an outer shape formed in a box shape, one end of the main plug unit being adapted for connection to a cable, a plug of the main plug unit insertable into a plug insertion opening of the connector socket, a lock claw on the main plug unit, a latch opening in the plug insertion opening, the lock claw engaging the latch opening when the plug is inserted into the plug insertion opening, a slider slidably supported on the main plug unit, a cooperating element between the slider and the lock claw, the cooperating element forcibly disengaging the lock claw and the latch opening in response to sliding of the slider, and a pull-out handle supported by the slider and which can be grasped to apply a pull-out force to the main plug unit, whereby removal of the main plug unit is assisted.

According to a feature of the invention, there is provided a connector plug for connection to a connector socket comprising: a main plug unit, a plug in the main plug unit insertable into the connector socket, a lock claw on the main plug unit, a latch opening on the connector socket, the lock claw engaging the latch opening when the plug is engaged in the connector socket, a slider slidably disposed on the main plug unit, cooperating element in the main plug unit, the cooperating element cooperating with sliding of the slider to disengage the lock claw from the latch opening for permitting unplugging the plug from the connector socket.

In order to achieve this object, the present invention provides an angular connector plug comprising: a main plug unit having an outer shape in the form of a long, thin box and connected on one length-wise end to a cable, a plug of the main plug unit which can be inserted into a plug insertion opening of a connector socket, a locking claw of a locking member that can be locked into a latch opening on the insertion opening of the plug, a slider that is slidably supported by the main plug unit and that makes it possible to manually perform forcible disabling of the lock claw from the latch opening, and a pull-out handle supported by the slider. By grasping the pull-out handle with the fingertips, it is possible to apply a pullout force.

The following preferred embodiments of the present invention will be described.

1) The pull-out handle is formed roughly in the shape of a "C". A support end of the pull-out handle is pivotably supported by a support shaft disposed on the slider, which is formed as a rectangular frame. The pull-out handle can be manipulated so that when it is not being used, it is held within the outer form of the main plug unit, and when the pull-out handle is being used, it is projected out from the main plug unit.

3) A click projection is disposed on either the outer surface of the main plug unit facing the pull-out handle or the pull-out handle. A click groove is disposed on the remaining one of the above two elements. The click projection engages with the click groove so that when the pull-out handle is not being used, it is stored within the outer form of the main plug unit.

4) A finger-operated projection is formed integrally with an outer surface of the slider opposite from the cable. An external force from a fingertip can be applied to the finger-operated projection when pulling out the slider from the connector socket.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
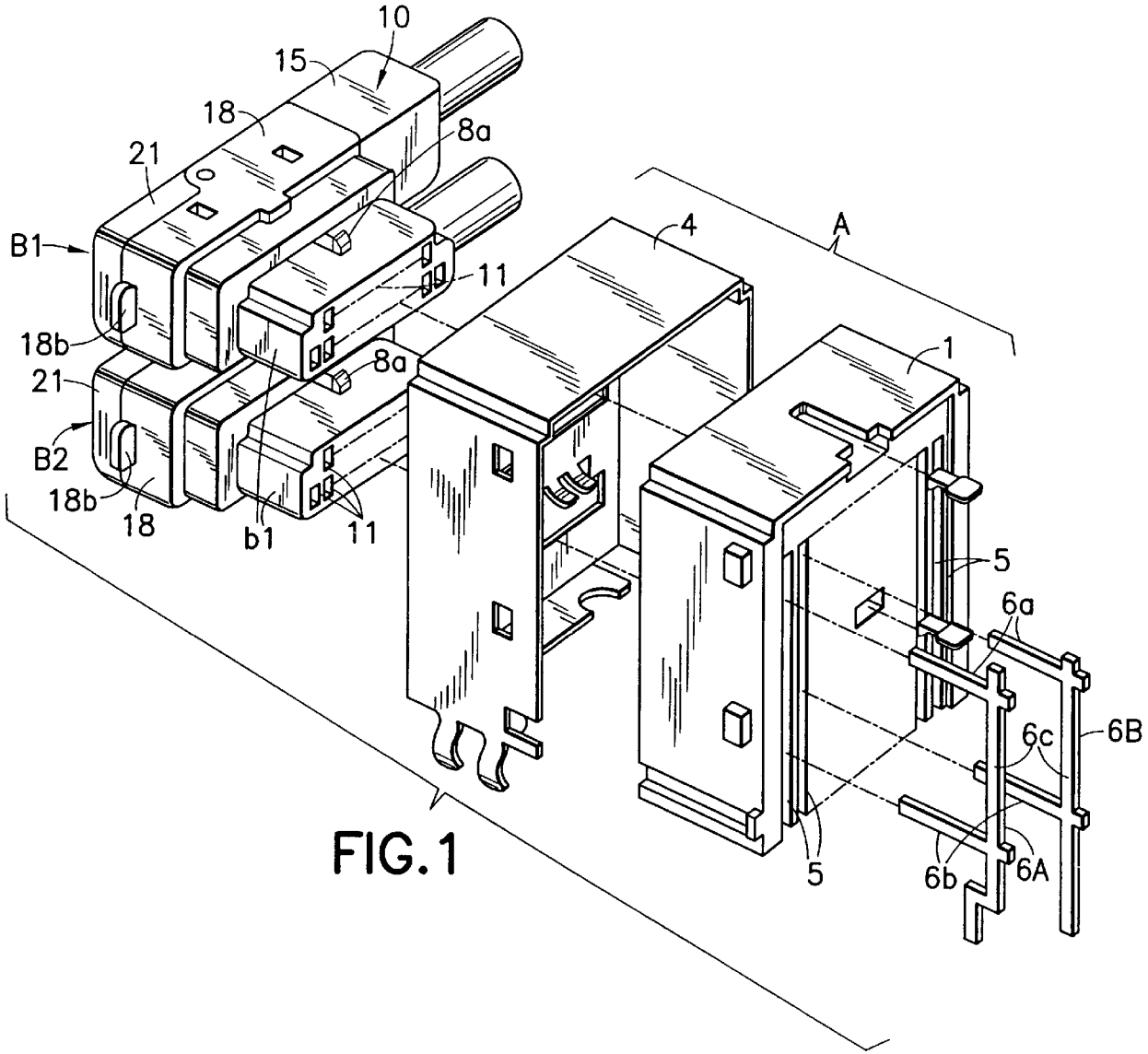
FIG. 1 is an exploded perspective drawing of a connector according to an embodiment of the invention showing the relationship between the angular connector plug and the connector socket.
Figure 2:
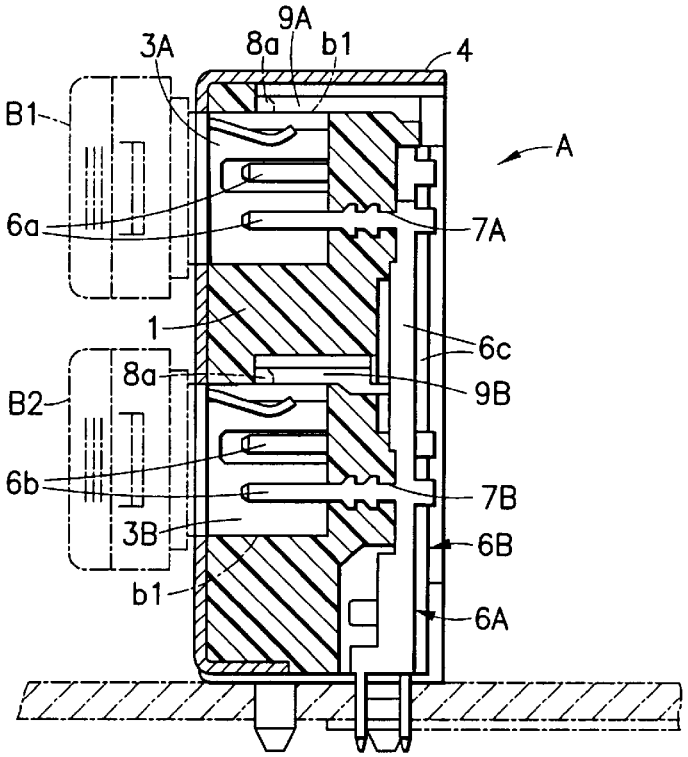
FIG. 2 is a cross-section drawing of the connector socket.

Referring to FIG. 1 and FIG. 2, an angular connector plug according to the present invention, which will be described in detail below, is used in conjunction with a connector socket A. Connector socket A includes a molded block 1, which is formed by injection molding a synthetic resin. Two plug insertion openings 3A, 3B are formed on the surface of molded block 1. Plug insertion openings 3A and 3B receive plugs b1 of angular connector plugs B1, B2.

In order to shield the inside of connector socket A from external magnetic and electric fields, a shield case 4 formed by bending a thin metal plate into a box shape is used to cover the front surface, the side surfaces, and the upper surface of molded block 1.

A plurality of pin slots 5 is formed at the back of molded block 1 adjacent to each other along the width of molded block 1. A plurality of shared connector pins 6A, 6B are fitted into pin slots 5 using a fitting device (not shown). Shared connector pins 6A, 6B may be formed by any convenient method, but are preferably stamped from a thin metal plate.

The corresponding connection ends in plug insertion openings 3A, 3B perform common functions. Shared connector pins 6A, 6B connect together corresponding pairs of connection ends 6*a*, 6*b*, which are arranged adjacent to each other in the same manner as the arrangement of plug insertion openings 3A, 3B. Shared connector pins 6A, 6B each includes a shared section 6*c* extending vertically along corresponding pin slots 5. The base portions of connection ends 6*a*, 6*b* are supported by shared sections 6*c* in a cantilevered manner at roughly a right angle.

Connection ends 6*a*, 6*b* are inserted through openings 7A, 7B, which are formed between plug insertion openings 3A, 3B and pin slots 5. A fitting device is used so that the ends of connection ends 6*a*, 6*b* project into corresponding plug insertion openings 3A, 3B.

Latch openings 9A, 9B are formed in plug insertion openings 3A, 3B. A lock claw 8*a* of a lock member 8 projecting from plug b1 of angular connector plugs B1, B2, drops into latch opening 9A, 9B. Engagement of latch openings 9A, 9B with lock claw 8*a* of lock member 8 prevents angular connector plugs B1, B2 from unexpectedly slipping out from plug insertion openings 3A, 3B.

Referring to FIG. 3 through FIG. 6, angular connector plugs B1, B2 include a main plug unit 10 formed in a long, thin box shape. Main plug unit 10 includes: a contact block 12; and a shield member 14. Contact block 12 is made from an insulating resin. A plurality of contact openings 11 are formed on contact block 12. Contact openings 11 are arranged at the same pitch used for connection ends 6*a*, 6*b* of shared connector pins 6A, 6B. Shield member 14 covers wires k of a cable K that are crimped to contacts 13 of contact block 12. Contact block 12 and shield member 14, which make up plug b1, are covered by a housing cover 15, which forms a section of main plug unit 10. A guide end 15*a* at one end of housing cover 15 guides cable K to the outside. A clamping ring 16 is fixed to the outer perimeter surface of cable K between guide end 15 and shield member 14, thus preventing cable K from being pulled out from main plug unit 10.

Figure 4:
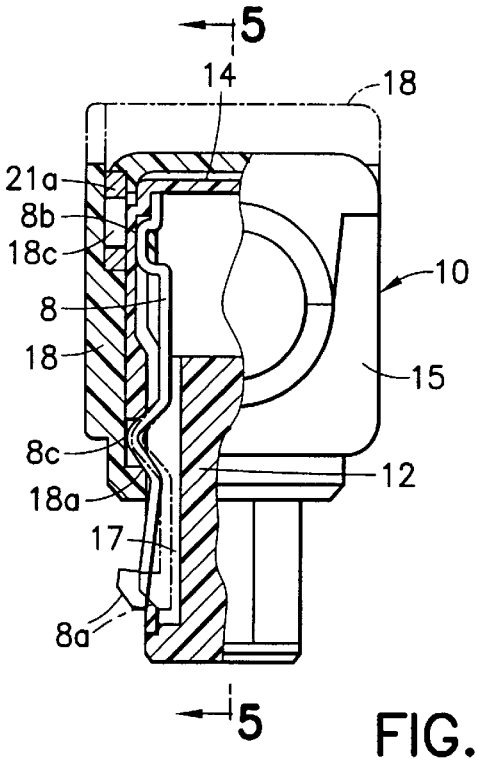
FIG. 4 is a right-side view drawing of the angular connector plug with one portion cut away.
Figure 5:
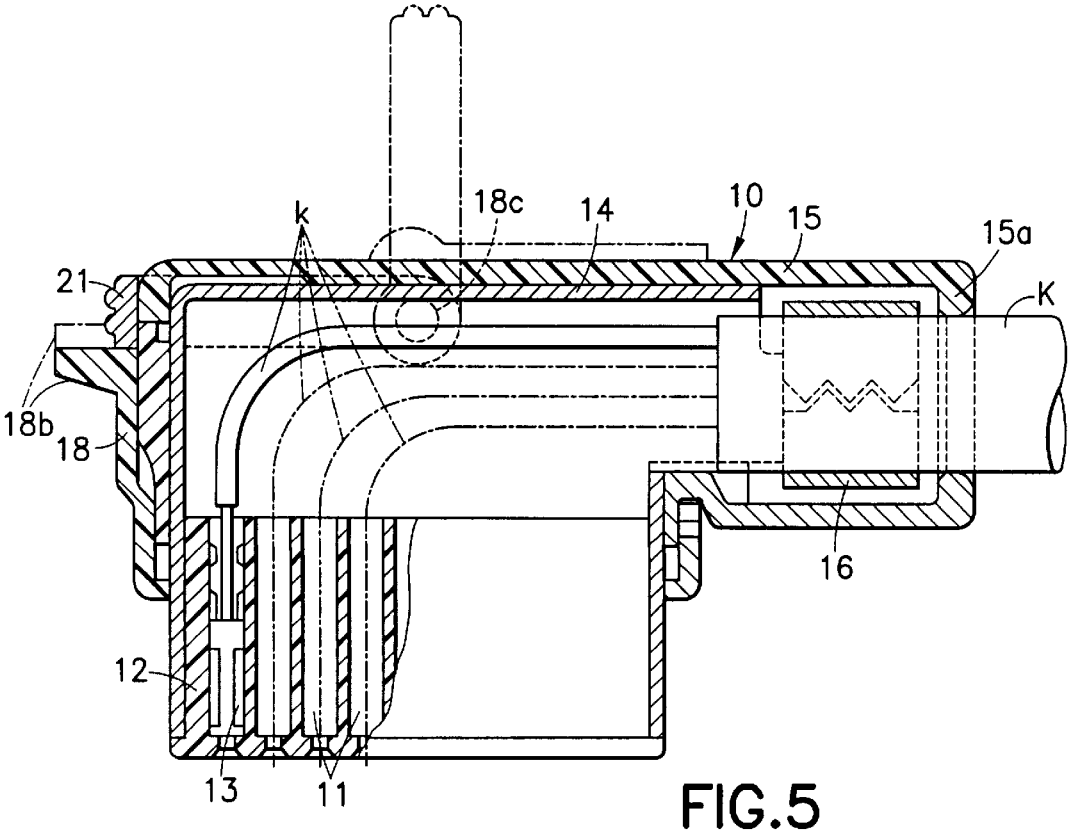
FIG. 5 is a cross-section drawing along the 5—5 line in FIG. 4.

Referring to FIG. 4, an attachment section 8*b* of lock member 8 is made from a metal plate having resilience. Attachment section 8*b* is fixed to shield member 14. Lock member 8 includes a projection 8*c* at its central portion. A lock claw 8*a* at the end of lock member 8 extends out from plug b1 at a holding groove 17 formed on the outer surface of contact block 12.

A rectangular frame-shaped slider 18 formed on the outer surface of main plug unit 10. Slider 18 is preferably made from resin. This frame-shaped slider 18 is able to move along main plug unit 10 in the direction of insertion of plug b1.

Figure 3:
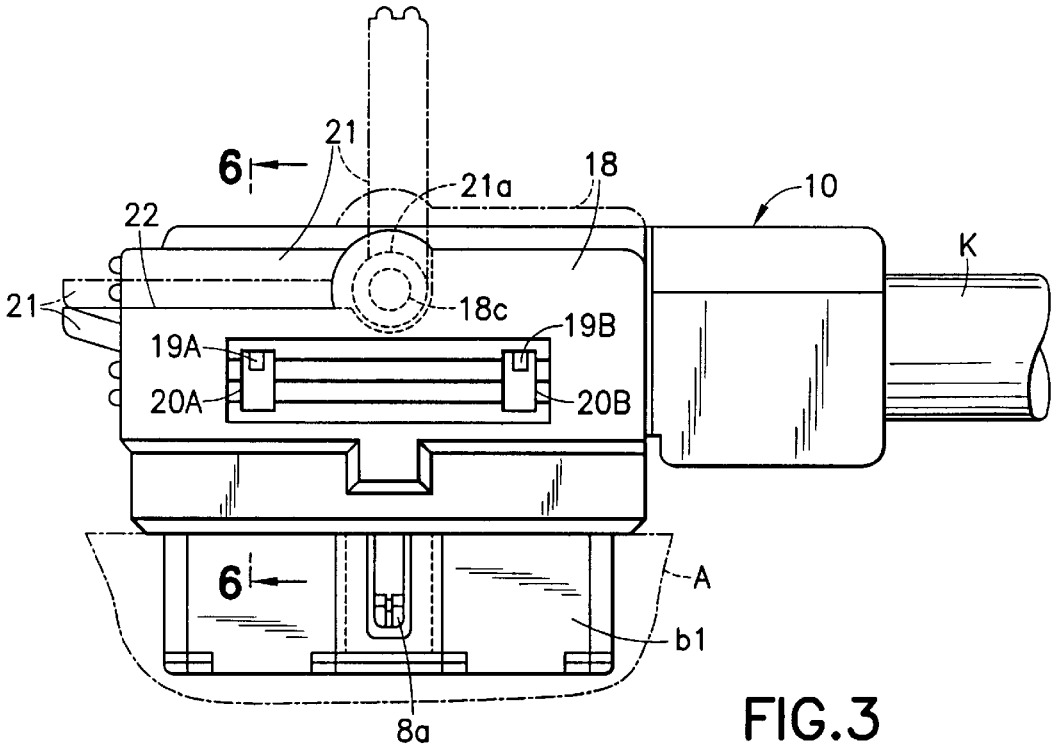
FIG. 3 is a plan drawing of the angular connector plug.
Figure 6:
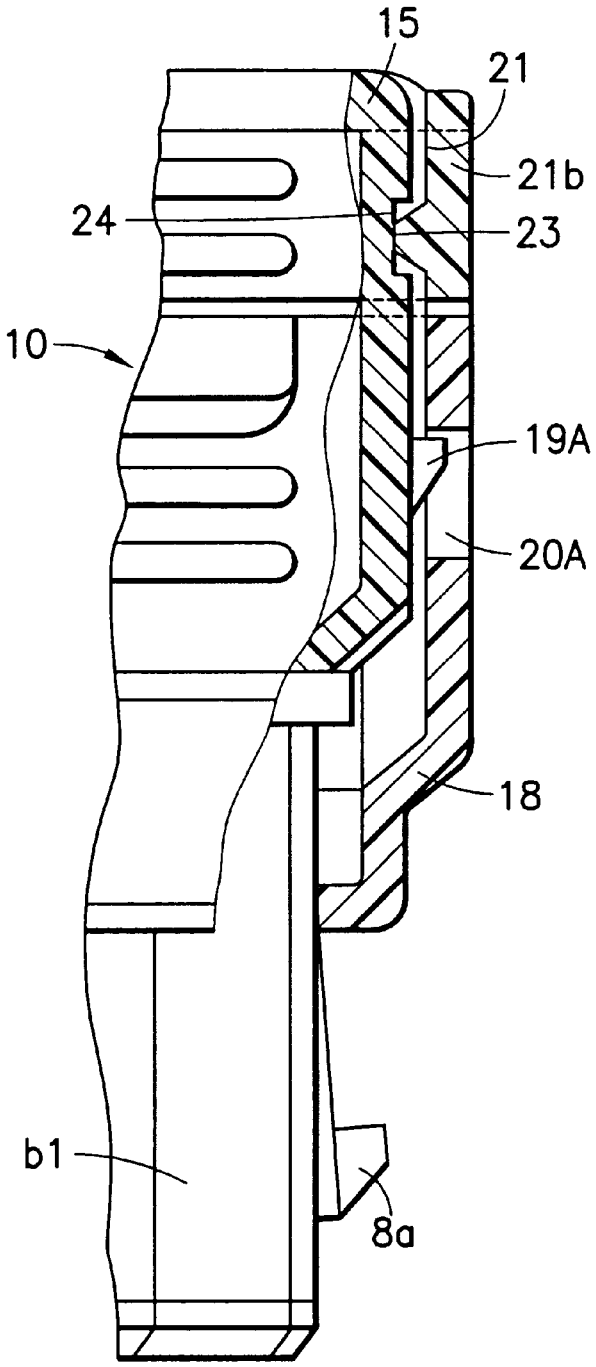
FIG. 6 is a schematic enlarged cross-section drawing along the 6—6 line in FIG. 3.

Referring to FIG. 3 and FIG. 6, two pairs of guide projections 19A, 19B are formed integrally on the upper and lower surfaces of housing cover 15. Guide projections 19A, 19B are positioned at slots 20A, 20B of frame-shaped slider 18. Slots 20A, 20B are oriented in the direction of insertion of plug b1.

An opening cam 18*a* is formed integrally at the opening of frame-shaped slider 18 that faces plug b1. Opening cam 18*a* can engages projection 8*c* when assembled as shown in FIG. 4. Displacement of opening cam 18*a* forces lock member 8 into the deflected position indicated by the dotted line.

The outer end surface of frame-shaped slider 18 opposite the entry of cable K includes an integral finger-operated projection 18*b*, which can be operated with a finger when necessary. Thus, if angular connector plugs B1, B2 are fixed rigidly in connector socket A, finger-operated projection 18*b* can be operated with a finger so that angular connector plugs B1, B2 can be pulled out from connector socket A.

A pivot shaft 18*c* is formed integrally at a central portion along the length of frame-shaped slider 18. Pivot shaft 18*c* projects in a direction opposite to the inner surface of frame-shaped slider 18. A support terminal 21*a* is formed in a C-shape on a pull-out handle 21. Support terminal 21*a* is rotatably supported by pivot shaft 18*c*. When pull-out handle 21 is at an unused position indicated by the solid line, pull-out handle 21 is held in main plug unit 10 within a cut-out 22 of frame-shaped slider 18. When pull-out to handle 21 is rotated to the position indicated by the dotted line, pull-out handle 21 can move over a wide range behind main plug unit 10 so that pull-out handle 21 can be grasped with the fingers thus allowing an external force to be applied.

Referring to FIG. 6, in order to prevent unexpected rotation of pull-out handle 21, small detent or clicking projections 23 project from sides 21*b* of pull-out handle 21. Clicking grooves 24 are formed on the outer surface of housing cover 15. Clicking grooves 24 are positioned in the path of clicking projections 23 so that clicking projections 23 can elastically fall into clicking grooves 24. Of course, clicking projections 23 can be formed on the outer surface of housing cover 15. In this case, clicking grooves 24 would be formed on sides 21*b* of pull-out handle 21.

Since angular connector plugs B1, B2 according to the embodiment shown in the drawings is configured as described above, the restorative force of lock member 8 urges frame-shaped slider 18 toward the position shown in the solid line in FIG. 4. In this state, pull-out handle 21 is in the unused state shown by the solid line and lock claw 8*a* of lock member 8 projects out from plug b1. When angular connector plugs B1, B2 are firmly pushed into plug insertion openings 3A, 3B of connector socket A, lock claws 8*a* engage latch openings 9A, 9B of corresponding insertion openings 3A, 3B. As a result, the connection between connector socket A and angular connector plugs B1, B2 is locked in, and angular connector plugs B1, B2 are prevented from being unexpectedly pulled out.

When angular connector plugs B1, B2 are to be pulled out from connector socket A, pull-out handle 21 is lightly pivoted around pivot shaft 18*c*. This cause clicking projection 23 to disengage from clicking groove 24, thereby moving pull-out handle 21 to its enabled position indicated by the dotted line. The space around this enabled positioned is not obstructed by other angular connector plugs B1, B2, thus allowing pull-out handle 21 to be easily grasped with the fingertips.

Thus, both pull-out handles 21 can be grasped so that angular connector plugs B1, B2 are pulled away from connector socket A. Pull-out handles 21 cause frame-shaped slider 18 to slide against main plug unit 10. Opening cam 18*a* of frame-shaped slider 18 engages projection 8*c* of lock member 8.

Referring to FIG. 4, lock member 8 is deformed inward as shown by the dotted lines, and latch claw 8*a* is moves out of engagement with latch openings 9A, 9B, thus disengaging a locked state between plugs b1 of angular connector plugs B1, B2 and connector socket A. When pull-out handles 21 are pulled out further, plugs b1 are pulled out from plug insertion openings 3A, 3B of connector socket A. However, if there is a strong connection between contact 13 and contact ends 6*a*, 6*b* of shared connector pins 6A, 6B, angular connector plugs B1, B2 can be easily pulled out from connector socket A by pressing on finger-operated projection 18*b* with the fingertip and pulling forward.

Once angular connector plugs B1, B2 have been pulled out, pull-out handle 21 can be released. Due to the restorative force from lock member 8, projections 8*c* will cause open cam 18*a* of frame-shaped slider 18 to naturally revert from the position indicated by the dotted line in FIG. 4 to the position indicated by the solid line. In this case, if pull-out handle 21 is returned to the position indicated by the solid line, the clicking projection 23 of pull-out handle 21 again engages clicking groove 24 of housing cover 15, thus preventing pull-out handle 21 from pivoting to a position that is difficult to access.

Thus, with angular connector plugs B1, B2 according to the embodiment shown in the drawings, connection to connector socket A is possible even if plug insertion openings 3A, 3B are close together and space is limited. Furthermore, a structure with a large number of pins is possible. Additionally, to pull out angular connector plugs B1, B2, pull-out handles 21, which are normally held in a stowed position within housing cover 15, are generally displaced to a more open area when necessary. This prevents objects from hitting and destroying pull-out handles 21 when they are not being used, and prevents pull-out handles 21 from obstructing the use of other parts in the surrounding region.

In the embodiment described above, pull-out handle 21 is pivotably supported by frame-shaped slider 18. However, pull-out handle 21 can also be stored in a guide groove formed in frame-shaped slider 18 when not in use and can be pulled outside of housing cover 15 from the guide groove when necessary.

As the description above makes clear, according to the present invention, a cable extends out from one end of a main plug unit shaped as a long, thin box shape. A frame-shaped slider is disposed on the main plug unit to allow lock member manipulation. A pull-out handle, that is generally stowed within the main plug unit, is pulled out when necessary. Thus, there is provided an angular connector plug suited for connector sockets having a plurality of plug insertion openings with many connector pins and having limited space with which to perform manual operations.

One skilled in the art will recognize that, although the above description covers a two-socket device, the same technique is applicable to more or less sockets. For example, a single socket, or three or more sockets may be use the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An angular connector plug for connection with a connector socket comprising:

a main plug unit having an outer shape formed in a box shape;

one end of said main plug unit being adapted for connection to a cable;

a plug of said main plug unit insertable into a plug insertion opening of said connector socket;

a lock claw on said main plug unit;

a latch opening in said plug insertion opening;

said lock claw engaging said latch opening when said plug is inserted into said plug insertion opening;

a slider slidably supported on said main plug unit;

a cooperating element between said slider and said lock claw;

said cooperating element forcibly disengaging said lock claw and said latch opening in response to sliding of said slider; and a pull-out handle supported by said slider and which can be grasped to apply a pull-out force to said main plug unit, whereby removal of said main plug unit is assisted.

2. An angular connector plug according to claim 1 wherein:

a support end of said pull-out handle is supported by a pivot shaft disposed on said slider; and said pull-out handle is rotatable from a stored position within said main plug unit to an operative position projecting from said main plug unit, whereby said pull-out handle is accessible for assisting in removing said main plug unit.

3. An angular connector plug according to claim 1 wherein:

said pull-out handle is movably supported along a guide groove;

said guide groove being formed on said slider in a direction in which said plug is inserted;

said pull-out handle being movable between a stored position within an outer form of said main plug unit, and a use position projecting from said main plug unit.

4. An angular connector plug according to claim 2 further comprising:

a clicking projection on one of an outer surface of said main plug unit facing said pull-out handle and said pull-out handle;

a clicking groove on the other of said outer surface of said main plug unit facing said pull-out handle and said pull-out handle; and an engagement between said clicking groove and said clicking projection forming a detent to keep said pull-out handle stored within the outer form of said main plug unit when said pull-out handle is not being used.

5. An angular connector plug according to claim 1 further comprising:

a finger-operated projection on said slider;

said finger-operated projection being disposed at a location distal to said cable, on which a fingertip can apply external force when pulling said angular connector plug from said connector socket, is formed integrally with the outer surface of said slider opposite from said cable.

6. An angular connector plug according to claim 3 further comprising:

a clicking projection on one of an outer surface of said main plug unit facing said pull-out handle and said pull-out handle;

a clicking groove on the other of said outer surface of said main plug unit facing said pull-out handle and said pull-out handle; and an engagement between said clicking groove and said clicking projection forming a detent to keep said pull-out handle stored within an outer form of said main plug unit when said pull-out handle is not being used.

7. An angular connector plug according to claim 2, wherein said pull-out handle is formed roughly in the shape of a "C".

8. A connector plug for connection to a connector socket comprising:

a main plug unit;

a plug in said main plug unit insertable into said connector socket;

a lock claw on said main plug unit;

a latch opening on said connector socket;

said lock claw engaging said latch opening when said plug is engaged in said connector socket;

a slider slidably disposed on said main plug unit;

cooperating element in said main plug unit;

said cooperating element cooperating with sliding of said slider to disengage said lock claw from said latch opening for permitting unplugging said plug from said connector socket.

9. A connector plug according to claim 8, further comprising:

a projection on said slider; and said projection being positioned and shaped to permit finger engagement therewith to assist in unplugging said plug from said connector socket.

10. A connector plug according to claim 8, further comprising:

a pull-out handle pivotably disposed on said slider;

said pull-out handle being pivotable between a protected position and an extended operative position where it permits application of force to assist in unplugging said plug from said connector socket.

11. A connector plug according to claim 10, further comprising:

a projection on said slider; and said projection being positioned and shaped to permit finger engagement therewith to assist in unplugging said plug from said connector socket.

* * * * *